US005170778A

United States Patent [19]

Jamis

[11] Patent Number: 5,170,778

[45] Date of Patent: Dec. 15, 1992

[54] BODY MASSAGING DEVICE

[76] Inventor: Ron Jamis, 4231 Lakemore Dr., Tallahassee, Fla. 32303

[21] Appl. No.: 746,806

[22] Filed: Aug. 14, 1991

Related U.S. Application Data

[63] Continuation of Ser. No. 607,681, Nov. 1, 1990, abandoned.

[51] Int. Cl.[5] ..... A61H 15/00

[52] U.S. Cl. ..... 128/57

[58] Field of Search ..... 128/57, 60, 61, 24 R, 128/24.3

[56] References Cited

U.S. PATENT DOCUMENTS

| | | | |
|---|---|---|---|
| 1,533,528 | 4/1925 | Weaver | 128/57 |
| 1,850,862 | 3/1932 | Boyd | 128/57 |
| 2,221,785 | 11/1940 | Douglas | 128/57 |
| 3,616,794 | 11/1971 | Gromala | 128/57 |
| 3,705,579 | 12/1972 | Morini et al. | 128/57 |
| 3,750,654 | 8/1973 | Shiu | 128/57 |
| 4,945,900 | 8/1990 | Masuda | 128/60 |

*Primary Examiner*—Robert A. Hafer
*Assistant Examiner*—David J. Kenealy
*Attorney, Agent, or Firm*—Larson & Taylor

[57] ABSTRACT

In accordance with the invention, a body pressure massaging device is provided which permits a user to massage his back by placing said device between his back and a flat surface. The device comprises a threaded cylindrical dowel which is used to assemble a central narrow circular element having a shaped surface together with a pair of rounded end elements. The central narrow element has a hollow center with threads that mate with the threaded cylindrical dowel so that the central element may be mounted anywhere on the dowel. On each side of the central narrow element there is mounted on the dowel a rounded end element or bell shaped cap. The surface of each of the bell shaped caps has a raised bulbous ridge around the largest circumference of the cap. Each cap has a hollow cylindrical region with threads mating with the threads of the cylindrical member for mounting each cap a specific distance from the central narrow element. The back pressure massage device operates by placing the device on the floor with the user lying on the device and moving along the floor to rotate the device thus effecting a massaging of the back without injuring the spinal column. The individual rounded end elements may be removed from the device and placed on the floor to massage specific muscles, stress points, and feet.

2 Claims, 2 Drawing Sheets

BODY MASSAGING DEVICE

This application is a continuation of application Ser. No. 07/607,681 filed Nov. 1, 1990, abandoned.

FIELD OF THE INVENTION

This invention relates generally to massage devices and more specifically, to an improved massager for massaging muscles and stress points of the body.

BACKGROUND OF THE INVENTION

It has been demonstrated by a large number of experiments that massage, as a remedial treatment, is very effective in various ailments. Since the spinal column is the trunk line from which a large number of nerves branch out to various organs, it is the center of various ailments and certain schools of healing have developed a system of treatment directed to the rectification of spinal defects, which in turn, relieves pressure on the nerves and improves the functioning of body organs by massaging specific stress points.

One such school of thought is the science of acupressure. Acupressure teaches that the internal functions of the body can be augmented by external stimulation of various anatomical parts and certain points. These points are called "effect points" or "stress points" and are located along the back of major trunks of the body. Thus, stimulation of the spine or soles of the feet have beneficial effect on the kidneys, spleen, pancreas, stomach, lungs, etc. These points have been stimulated in the past by finger pressure.

The following U.S. Patents disclose devices which may be used to massage the body: U.S. Pat. No. 1,533,528 (Weaver); 1,850,862 (Boyd); 3,616,794 (Gromala); 3,705,579 (Morini et al.); and 3,750,654 (Shiu).

The Weaver patent discloses a back massage instrument that has a center portion with a v-shaped valley which is placed over the spinal column of the user. This device has no means for adjusting the center portion to various positions. Thus, users are forced to massage their backs with a massager that will not be tailored to their specific needs.

The Boyd patent discloses a non-adjustable foot exerciser that has support wheels attached at both ends distal from the center of the device. This device is designed to exercise the muscles in a foot and would be impractical to use as a back massager.

The Gromala patent discloses a non-adjustable back massager with handle sections that are attached to respective ends of a central rolling structure. This device requires that a trained person be present to roll the device on the back of a patient and thus increases the cost and ease of access of treatment.

The Morini et al. patent discloses a non-adjustable massaging device which has a center portion with a v-shaped valley which is placed over the spinal column of the user with two half-spheres attached to each end of the central portion. This device has no means for adjusting the center portion in relation to the half-spheres. Thus, the users are forced to massage their back with a massager that will not be tailored to their specific needs.

The Shiu patent discloses a massaging device which has a central portion with a v-shaped valley which is placed over the spinal column of the user and two conical sections attached to each end of the central portion in such a way so that the diameter of the conical regions flare outward from the central portion. This device has no method for adjusting the v-shaped valley to fit the particular needs of a user.

Although all of the above-discussed devices relate to back massagers, they have the various disadvantages mentioned above and fail to provide for adequate adjustments to the v-shaped grove to suit the variety of different spinal structures of various individuals. Furthermore, the prior art does not teach providing a separable muscle massage device which can be removed from the device and utilized to massage individual muscles or stress points.

SUMMARY OF THE INVENTION

In accordance with the invention, a body massaging device is provided which permits a user to massage his back by placing the device between his back and a flat surface or massage stress points by using removable ends that are bell or bullet shaped. The device comprises a threaded cylindrical dowel which is used to assemble a central narrow cylindrical element having a v-shaped surface together. The central narrow element has a hollow center with threads that correspond to the threaded cylindrical dowel so that the central element may be mounted anywhere on the dowel. On each side of the central narrow element there is mounted on the dowel a rounded element or bell shaped cap. The surface of each of the bell shaped caps has a raised bulbous ridge around the largest circumference of the cap. Each cap has a hollow cylindrical region with threads mating with the threads of the cylindrical dowel for mounting each cap a specific distance from the central narrow element. The back pressure massage device operates by placing the device on the floor with the user lying on the device and moving along the floor to rotate the device thus effecting a massaging of the back without injuring the spinal column.

This device allows for the user to adjust the device so as to conform to the specific characteristics of the spinal column of the user. The bell shaped caps provide an ergonomic design so that a person has an easy grip of the device. The bell shape also allows for the caps to be fully detached and used as independent deep muscle massagers and stress point massagers.

Other feature and advantages of the invention will be set forth in, or apparent from, the following detailed description of the preferred embodiment of the invention.

DESCRIPTION OF THE PREFERRED EMBODIMENTS

Figure 1:
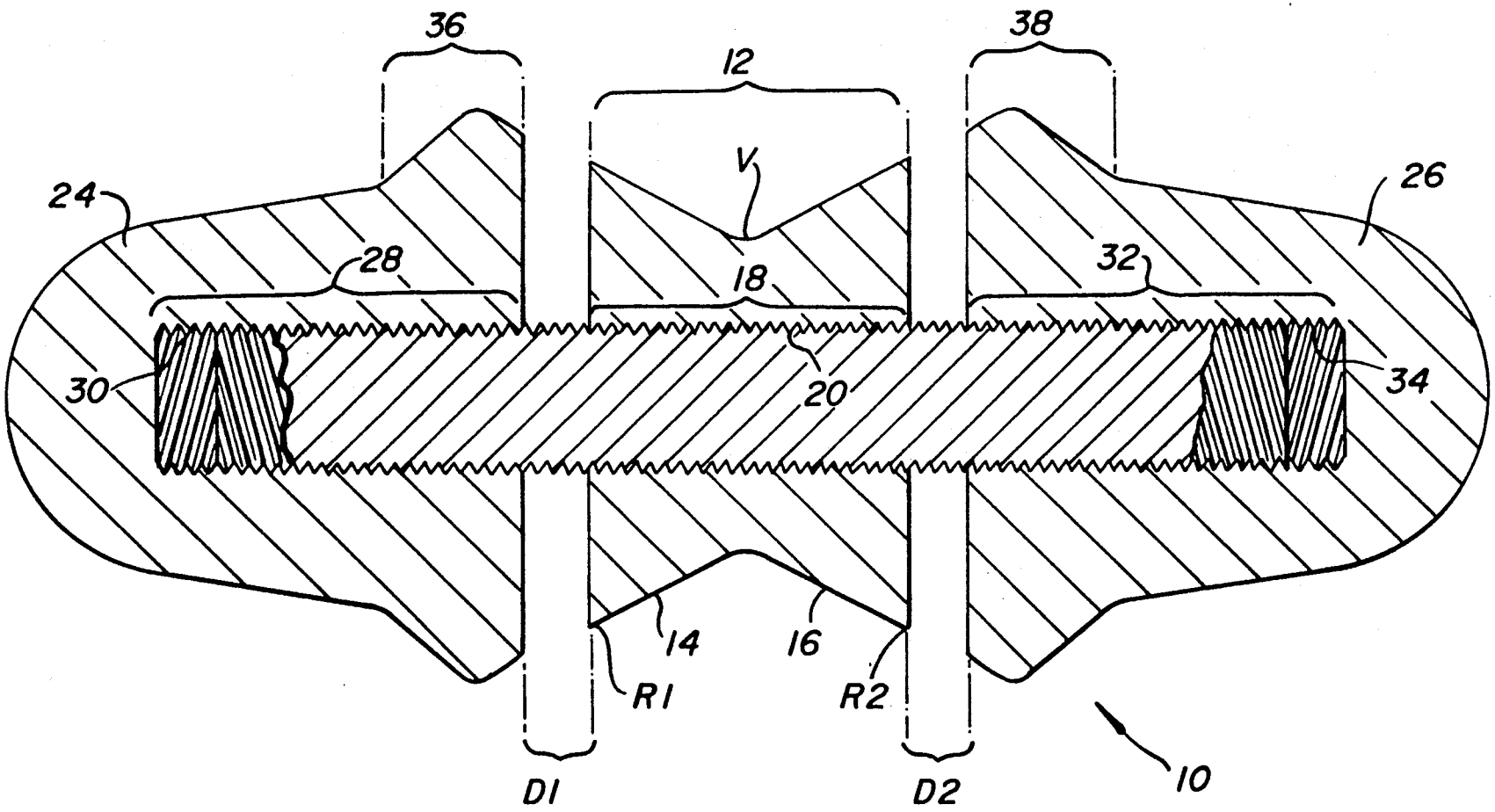
FIG. 1 is a cross sectional view of a back pressure tool constructed in accordance with a preferred embodiment of the invention.

Referring to FIG. 1, a back pressure massage device constructed in accordance with a preferred embodiment of the invention is shown. The back pressure device 10 is composed of a relatively narrow central element 12 and symmetrically on each side of this central element 12 is a bell shaped cap 24 and 26, described below, which attach to the left and right sides of central element 12 respectively. The central element 12 has the external surface thereof shaped in the form of two truncated cones 14 and 16. In a preferred embodiment, the central element 12 is formed by a contiguous block of material such as rubber, or any other compound which duplicates the density and softness of the human hand. Central element 12 is shaped with a v-shaped valley, and two ridges, R1 and R2, on either side of the v-shaped valley. In a preferred embodiment, central element 12 has a hollow center 18 with threads 20 on the inner surface of the hollow center 18. A threaded dowel 22 is located in hollow center 18 and has threads 23 on the outer surface of dowel 22 which engage threads 20. This permits the central element 12 to be located at any one point along dowel 22. In a storage position, the central element 12 would be positioned to be equidistant from both ends of dowel 22.

In an alternate embodiment, central element 12 has a hollow center 18 designed to accept a dowel 22. Central element 12 slides freely on dowel 22, thus permitting central element 12 to be located at any point along dowel 22.

Attached to each end of dowel 22 is a bell shaped cap 24 and 26. In a preferred embodiment, bell shaped cap 24 has a hollow cylindrical section 28 with threads 30 on the inner surface of the section 28. Threads 28 are designed to engage threads 20 of dowel 22. This allows for the end cap 24 to have an adjustable displacement D1 from the central region 12. A raised ridge 36 is located at the base of cap 24. Ridge 36 may be an integral part of cap 24 or may be attached to cap 24 by mounting, for example, a rubber bead on cap 24. In a preferred embodiment, ridge 36 is an integral portion of cap 24 which may be made of rubber or the like.

In a similar fashion, the right bell shaped cap 26 has a hollow cylindrical section 32 with threads 34 on the inner surface of section 32. Threads 34 are also designed to engage threads 20 of dowel 22. This allows for the end cap 26 to have an adjustable displacement of D2 from the central region 12. A raised ridge 38 is located at the base of cap 26. Ridge 38 may be an integral part of cap 26 or may be attached to cap 26 by mounting, for example, a rubber bead on cap 26. In a preferred embodiment, ridge 38 is an integral portion of cap 26 which may be made of rubber or the like.

While in a preferred embodiment a threaded dowel 22 is used, any other device may be used in place of dowel 22 so long as the device attaches bell shaped caps 24 and 26 to central element 12 in an adjustable and detachable fashion.

Figure 2:
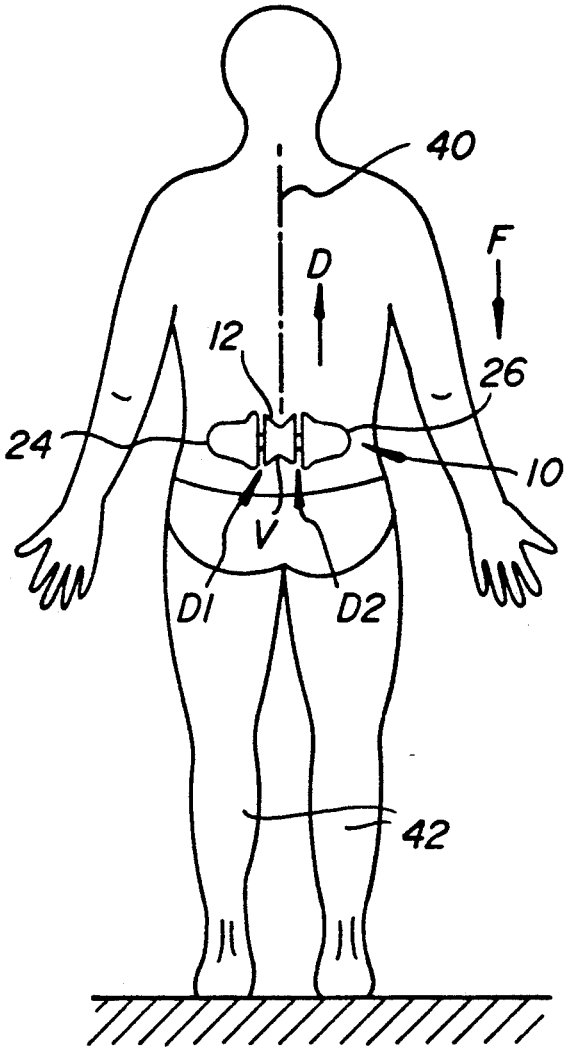
FIG. 2 shows the device of FIG. 1 during the massage of a person.

FIG. 2 depicts the back pressure massage device 10 in use. As may be seen in FIG. 2, a person would first adjust the displacements D1 and D2 to suit the particular requirements of his or her back by screwing or unscrewing caps 24 and 26 to achieve the proper displacements from the central region 12. Then the person would place their back parallel to a flat surface such as a wall or floor as depicted in FIG. 2. Then the back pressure massage device 10 is placed between the wall and the person's back in such a way so as to align the valley "v" with the spinal cord 40. A similar effect is achieved by lying on the floor and placing the back pressure massage device on the floor in such a way that the v-shaped portion of the central element is in alignment with the spinal cord 40. Motion of the back pressure massage device 10 is actuated by the person moving their body parallel to the floor by bending their knees 42 so as to move their body in direction F as depicted in FIG. 2. This results in the device 10 moving in direction D as depicted in FIG. 2. By reversing the direction of movement F, the back pressure massage device 10 will move in the opposite direction of D. Thus, by moving back and forth the back pressure massage device 10 will move up and down the spinal column. This movement of the device 10 will cause pressure to be exerted on the muscles and nerves associated with spinal column 40 and thus generate the beneficial effects discussed above.

The caps 24 and 26 may be completely disassembled from the device 10 and used as independent deep muscle or stress point massagers. The caps 24 and 26 are placed on the floor with the bell shaped ends up. The user may position the bell shaped caps 24 and 26 in any width to provide precise pressure to the upper body trapezoids, rhomboids, posterior deltoids, etc. In this usage, the body massaging device 10 is also effective at working the gluteus maximus and gluteus minimus muscles of the buttocks.

Another way of using the device 10 is place caps 24 and 26 on the floor with bell shaped ends 24 and 26 up. The user could then sit in a chair and place his/her feet on top of ends 24 and 26 respectively. By applying a downward pressure, a deep tissue foot massage may be accomplished.

Yet another use for the body massaging device 10 is to use the bell shaped caps 24 and 26 as hand held tools to work areas of the body normally worked with the hands and fingers. Since the device 10 is ergonomically designed, it is easy to hold and can be used in place of a thumb or finger for applying pressure to stress points. This helps to eliminate the irritation which may occur due to sharp fingernails.

Although the present invention has been described to specific exemplary embodiments thereof, it will be understood by those skilled in the art that variations and modifications can be effected in these exemplary embodiments without departing from the scope and spirit of the invention.

What is claimed is:

1. A pressure massage device permitting a user to massage his back by placing said device between his back and a flat surface, said device comprising: a cylindrical dowel; a narrow cylindrical element with a central V groove therein and with a hollow center for engaging said cylindrical dowel; a pair of bell shaped caps, the surface of each of said caps having a half spherical end portion and a raised bulbous ridge around the largest circumference of each of said caps for forming a bell shape, a bell shaped cap being disposed on each side of said narrow cylindrical element to provide for the massaging of muscles and nerves adjacent to a spinal column of a user, each of said caps having a central hollow cylindrical region to receive said cylindrical dowel for adjustably mounting each of said caps at predetermined locations with respect to said narrow cylindrical element, whereby said pressure massage device rolls on itself by movement of the user's back and thus effects a massaging of the back without injuring the spinal column and wherein said bell shaped caps are removable from said cylindrical dowel to provide a pair of independent massage devices.

2. A pressure massage device permitting a user to massage his back by placing said device between his back and a flat surface, said device comprising: a threaded cylindrical dowel; a narrow cylindrical element with a central V groove therein and with a hollow center having a threaded region on the inner surface of said hollow center for engaging said threaded cylindrical dowel; a pair of bell shaped caps, the surface of each of said caps having a half spherical end portion and a raised bulbous ridge around the largest circumference of each of said caps for forming a bell shape, a bell shaped cap being disposed on each side of said narrow cylindrical element to provide for the massaging of muscles and nerves adjacent to a spinal column of a user, each of said caps having a central hollow cylindrical region with threads to receive said threaded cylindrical dowel for adjustably mounting each of said caps at predetermined locations with respect to said narrow cylindrical element, whereby said pressure massage device rolls o itself by movement of the user's back and thus effects a massaging of the back without injuring the spinal column and wherein said bell shaped caps are removable from said cylindrical dowel to provide a pair of independent massage devices.

* * * * *

UNITED STATES PATENT AND TRADEMARK OFFICE

CERTIFICATE OF CORRECTION

PATENT NO. : 5,170,778

DATED : December 15, 1992

INVENTOR(S) : Ron Jamis

It is certified that error appears in the above-identified patent and that said Letters Patent is hereby corrected as shown below:

On the title page, item [76] Inventor: delete "4231 Lakemore Dr., Tallahassee, Fla. 32303" and insert --P.O. Box 1492, Tallahassee, Fl 32302--.

Signed and Sealed this

Ninth Day of November, 1993

*Attest:*

*Attesting Officer*

BRUCE LEHMAN

*Commissioner of Patents and Trademarks*